US010060038B2

(12) United States Patent
Carter et al.

(10) Patent No.: US 10,060,038 B2
(45) Date of Patent: Aug. 28, 2018

(54) MODIFIED LECITHIN CORROSION INHIBITOR IN FLUID SYSTEMS

(71) Applicant: Buckman Laboratories International, Inc., Memphis, TN (US)

(72) Inventors: Amy E. Carter, Cordova, TN (US); Donald G. Jenkins, Memphis, TN (US); Daniel Glover, Brighton, TN (US); Carlton E. Hagen, Memphis, TN (US)

(73) Assignee: Buckman Laboratories International, Inc., Memphis, TN (US)

( * ) Notice: Subject to any disclaimer, the term of this patent is extended or adjusted under 35 U.S.C. 154(b) by 0 days.

(21) Appl. No.: 14/201,949

(22) Filed: Mar. 10, 2014

(65) Prior Publication Data

US 2014/0264179 A1 Sep. 18, 2014

Related U.S. Application Data

(60) Provisional application No. 61/783,756, filed on Mar. 14, 2013.

(51) Int. Cl.

*C23F 11/167* (2006.01)
*C23F 11/10* (2006.01)
*C10G 75/02* (2006.01)

(52) U.S. Cl.

CPC ..... *C23F 11/1673* (2013.01); *C10G 75/02* (2013.01); *C23F 11/10* (2013.01)

(58) Field of Classification Search

CPC ..... C23F 11/167; C23F 11/1673; C23F 11/00; C10M 105/74; C10M 107/32; C10M 107/34; C10M 137/02; C10M 137/04; C10N 2030/12; C10N 2230/12; C10G 75/02

USPC ..... 422/7, 12–17, 37; 106/14.05, 14.12, 106/14.41–14.43; 252/68, 387–407

See application file for complete search history.

(56) References Cited

U.S. PATENT DOCUMENTS 2,221,162 A 11/1940 Ashburn et al.
2,997,398 A 8/1961 Kronstein et al.
4,056,494 A 11/1977 Kronstein et al.
4,520,153 A * 5/1985 Kronstein et al. ..... 524/145
4,599,185 A * 7/1986 Towers et al. ..... 252/68
4,915,934 A 4/1990 Tomlinson
5,008,037 A * 4/1991 Weete ..... A23J 7/00 426/662
5,082,592 A 1/1992 McDonald
5,120,357 A * 6/1992 Eichberg et al. ..... 106/14.22
5,152,928 A * 10/1992 Kudo ..... A23J 7/00 252/364
5,368,775 A 11/1994 Rossi et al.
5,374,434 A * 12/1994 Clapp ..... A21D 8/08 426/116
5,431,719 A * 7/1995 Clapp ..... A23D 7/0053 426/609
5,492,648 A * 2/1996 Lau ..... A01N 25/04 424/405
5,567,456 A * 10/1996 Clapp ..... A21D 8/08 426/116
5,587,009 A 12/1996 Besse et al.
5,658,374 A * 8/1997 Glover ..... 106/2
5,849,220 A * 12/1998 Batton et al. ..... 252/396
6,140,519 A * 10/2000 Hutton ..... A23J 7/00 426/662
6,723,257 B2 * 4/2004 Libutti et al. ..... 252/388
7,008,910 B2 * 3/2006 Komar ..... 510/201
7,311,877 B2 12/2007 Crovetto
7,407,623 B2 8/2008 Whitekettle et al.
7,435,707 B2 * 10/2008 Langer ..... C10M 171/00 508/154
8,044,004 B2 * 10/2011 Goto et al. ..... 508/308
8,217,199 B2 * 7/2012 Chung et al. ..... 564/15
2005/0197260 A1 * 9/2005 Johnson et al. ..... 508/216

(Continued)

FOREIGN PATENT DOCUMENTS

CN 102174343 9/2011

OTHER PUBLICATIONS

International Preliminary Report on Patentability issued in corresponding International Patent Application No. PCT/US2014/022223 dated Sep. 24, 2015 (11 pages).

(Continued)

*Primary Examiner* — Harold Y Pyon
*Assistant Examiner* — Matthew R Diaz
(74) *Attorney, Agent, or Firm* — Kilyk & Bowersox, P.L.L.C.

(57) ABSTRACT

An anti-corrosion composition containing at least one fatty acid ester, at least one glycol, at least one ethylene oxide/propylene oxide (EO/PO) alkoxylate, at least one polyethylene glycol ester, and at least one modified lecithin is provided. An anti-corrosion composition also is provided which contains at least one fatty acid ester, at least one glycol, at least one sorbate, and at least one modified lecithin. A method of preparing an anti-corrosion composition is also provided. At least one modified lecithin can be blended with at least one fatty acid ester, at least one glycol, at least one EO/PO alkoxylate, or at least one polyethylene glycol ester, or any combination thereof. A method of inhibiting corrosion of a metal surface including applying an anti-corrosion composition to the metal surface in an amount effective to inhibit corrosion of the metal surface is further provided.

22 Claims, 1 Drawing Sheet

(56) References Cited

U.S. PATENT DOCUMENTS

| | | | | |
|---|---|---|---|---|
| 2007/0078057 | A1* | 4/2007 | Rowley | A01N 25/04 504/206 |
| 2007/0078068 | A1* | 4/2007 | Askew | 508/428 |
| 2008/0176778 | A1* | 7/2008 | Seemeyer | C10M 173/025 508/433 |
| 2010/0015250 | A1* | 1/2010 | Smith | 424/658 |
| 2010/0016187 | A1* | 1/2010 | Smith et al. | 508/158 |
| 2011/0160098 | A1* | 6/2011 | Smith | 507/128 |
| 2012/0315369 | A1* | 12/2012 | Kester | B65D 83/752 426/609 |
| 2013/0048238 | A1 | 2/2013 | Glover et al. | |

OTHER PUBLICATIONS

International Search Report and Written Opinion issued in corresponding International Patent Application No. PCT/US2014/022223 dated Jun. 5, 2014 (15 pages).

* cited by examiner

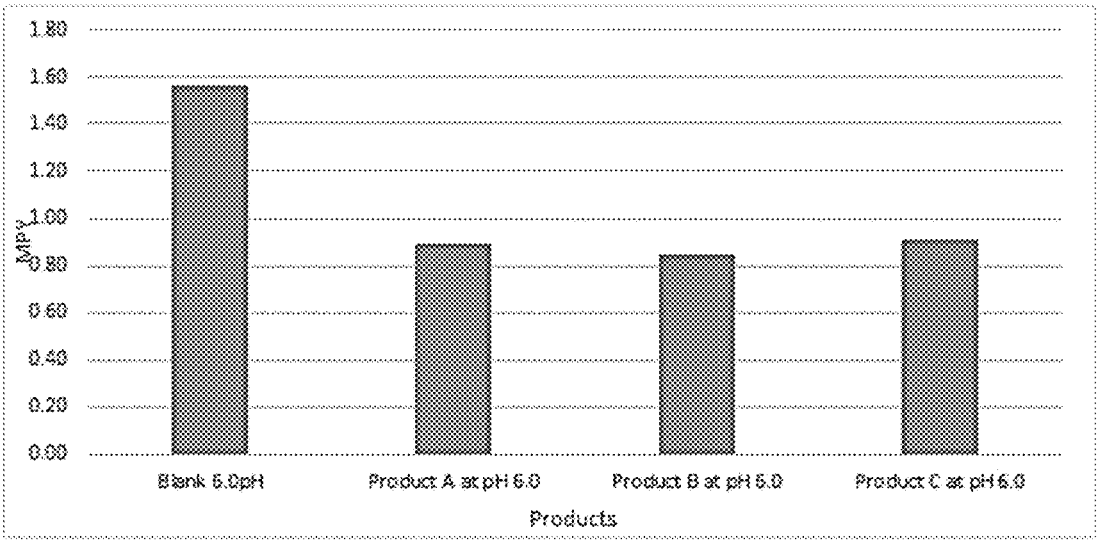
1.80
1.60
1.40
1.20
1.00
0.80
0.60
0.40
0.20
0.00
MPY
Blank 5.0pH
Product A at pH 5.0
Product B at pH 5.0
Product C at pH 5.0
Products

MODIFIED LECITHIN CORROSION INHIBITOR IN FLUID SYSTEMS

This application claims the benefit under 35 U.S.C. § 119(e) of prior U.S. Provisional Patent Application No. 61/783,756, filed Mar. 14, 2013, which is incorporated in its entirety by reference herein.

BACKGROUND OF THE INVENTION

The present invention relates to the inhibition of corrosion of a metal surface using one or more anti-corrosion agents.

Corrosion has been the subject of scientific study for more than 150 years. Corrosion is a naturally occurring phenomenon that relates to the deterioration of a material or its properties because of a reaction with its environment. In addition to reduced longevity, corrosion also produces oxides that can further deteriorate a system by erosion, plugging, and fouling. Oxides can deposit on heat transfer surfaces, reducing efficiency, and increasing energy costs. Common sources of corrosion include dissolved oxygen, bacteria, electrolysis (stray current), differential metal (dielectric), and differential cells. Flow, temperature, and pressure can also increase the corrosion rate. As products and manufacturing processes have become more complex and the consequences of corrosion more costly, the greater attention is being given to the control and prevention of corrosion.

Accordingly, there is a continued need to identify more effective anti-corrosion agents that minimize financial and environment costs with better toxicological profiles.

SUMMARY OF THE INVENTION

A feature of the present invention is to inhibit corrosion of a metal surface.

Another feature of this invention is to provide methods of using an anti-corrosion agent having low toxicity and high efficacy to prevent or minimize the corrosion of metal surfaces.

Methods of inhibiting the corrosion of metal surfaces located in variety of different systems and environments are also features of this invention.

To achieve these and other advantages and in accordance with the purposes of the present invention, as embodied and broadly described herein, the present invention provides an anti-corrosion composition containing at least one fatty acid ester, at least one glycol, at least one ethylene oxide/propylene oxide (EO/PO) alkoxylate, at least one polyethylene glycol ester, and at least one modified lecithin. The at least one modified lecithin can be or include acetylated lecithin, ethoxylated lecithin, hydroxylated lecithin, sulfonated lecithin, phosphorylated lecithin, alkoxylated lecithin, halogenated, lecithin, hydroxylated lecithin, chemically modified lecithin, or enzymatically modified lecithin, or any combination thereof. The at least one modified lecithin can be or include modified phosphatidylcholine, modified phosphatidylethanolamine, modified phosphatidylserine, modified phosphatidylinositol, modified phosphatidic acid, or any combination thereof.

The present invention also provides a method of preparing an anti-corrosion composition, including blending at least one modified lecithin at a temperature of from about 40° C. to about 80° C. for a period of from about 10 minutes to about 60 minutes or more, alone or with at least one fatty acid ester, at least one glycol, at least one EO/PO alkoxylate, at least one polyethylene glycol ester, or any combination thereof.

The present invention further provides a method of inhibiting corrosion of a metal surface including applying an anti-corrosion composition containing at least one modified lecithin to the metal surface in an amount effective to inhibit corrosion of the metal surface, wherein the at least one modified lecithin is or includes acetylated lecithin, ethoxylated lecithin, hydroxylated lecithin, sulfonated lecithin, phosphorylated lecithin, halogenated, lecithin, hydroxylated lecithin, physically modified lecithin, chemically modified lecithin, or enzymatically modified lecithin, or any combination thereof. The anti-corrosion composition can further contain at least one fatty acid ester, glycol, at least one EO/PO alkoxylate, or at least one polyethylene glycol ester, or any combination thereof. The applying can include one or more of flowing, coating, sponging, wiping, spraying, painting, showering, and misting of the anti-corrosion composition. The method can further include contacting the metal surface with at least one corrosive agent from which protection is sought.

The present invention further provides an anti-corrosion composition containing at least one fatty acid ester, at least one glycol, at least one sorbate, and at least one modified lecithin. The at least one fatty acid ester, at least one glycol, and/or the at least one modified lecithin contained in this composition can be the same or similar to that indicated above for the first anti-corrosion composition. This composition can be made and used in inhibiting corrosion of a metal surface in similar methods as those indicated above.

Additional features and advantages of the present invention will be set forth in part in the description which follows, and in part will be apparent from the description, or may be learned by practice of the present invention. The objectives and other advantages of the present invention will be realized and obtained by means of the elements and combinations particularly pointed out in the written description and appended claims.

It is to be understood that both the foregoing general description and the following detailed description are exemplary and explanatory only and are only intended to provide a further explanation of the present invention, as claimed.

The accompanying drawing, which is incorporated in and constitutes a part of this application, illustrates some of the features of the present invention and together with the description, serves to explain the principles of the present invention.

BRIEF DESCRIPTION OF THE DRAWING

The FIGURE is a bar graph which shows weight loss to corrosion of metal coupons after exposure to a corrosive environment, as expressed as mils (thousandths of an inch) per year penetration (MPY), for a metal coupon immersed in a solution that contains an anti-corrosion composition in accordance with an example of the present invention (Product B) and another coupon treated with a substantially similar composition (Product C), a coupon in a solution that contains a commercial product as a positive control (Product A), and a coupon in untreated solution (Blank), as described in Example 2.

DETAILED DESCRIPTION OF THE PRESENT INVENTION

The present invention provides an anti-corrosion composition comprising, consisting essentially of, consisting of, or including at least one fatty acid ester, at least one glycol, at least one ethylene oxide/propylene oxide (EO/PO) alkoxylate, at least one polyethylene glycol ester, and at least one modified lecithin. The anti-corrosion composition can contain from about 5 wt % to about 20 wt % (e.g., from 5 wt % to 15 wt %, from 5 wt % to 10 wt %, from 7 wt % to 20 wt %) of the at least one fatty acid ester, from about 2 wt % to about 20 wt % (e.g., from 2 wt % to 15 wt %, from 2 wt % to 10 wt %, from 2 wt % to 5 wt %, from 5 wt % to 20 wt %, from 7 wt % to 20 wt %) of at least one glycol, from about 1 wt % to about 10 wt % (e.g., from 1 wt % to 7 wt %, from 1 wt % to 5 wt %, from 1 wt % to 3 wt %, from 2 wt % to 10 wt %, from 4 wt % to 10 wt %) of the at least one EO/PO alkoxylate, from about 10 wt % to about 50 wt % (e.g., from 10 wt % to 40 wt %, from 10 wt % to 30 wt %, from 10 wt % to 20 wt %, from 15 wt % to 50 wt %, from 20 wt % to 50 wt %, from 25 wt % to 50 wt %, from 30 wt % to 50 wt %) of the at least one polyethylene glycol ester, and from about 20 wt % to about 80 wt % (e.g., from 20 wt % to 75 wt %, from 20 wt % to 70 wt %, from 20 wt % to 60 wt %, from 20 wt % to 50 wt %, from 20 wt % to 40 wt %, from 25 wt % to 80 wt %, from 30 wt % to 80 wt %, from 35 wt % to 80 wt %, from 40 wt % to 85 wt %, from 50 wt % to 80 wt %) of the at least one modified lecithin based on the total weight of the anti-corrosion composition. The balance, if any, can be inert ingredients, aqueous or non-aqueous solvents, or other ingredients described in this disclosure, and the like. More than one component can comprise each amount. As an example, the 20 wt % to 80 wt % of modified lecithin can comprise two or three different modified lecithins in any weight ratios, and so on.

The modified lecithin can be hydroxylated, ethoxylated, acetylated, halogenated (e.g., chlorinated, brominated, and/or iodinated), sulfonated, phosphorylated, alkoxylated, hydrolyzed, physically modified, chemically modified, enzymatically modified, or any combination thereof. The modified lecithin can have one or both fatty acid group removed, changed, or exchanged, for example, the modified lecithin can be a lysolecithin. Accordingly, the modified lecithin can be a monoglyceride, a diglyceride or a triglyceride. The removal of a fatty acid can be accomplished through hydrolysis, for example, enzymatic hydrolysis, or chemical hydrolysis using a base via saponification. The hydroxyl group(s) remaining on the glycerol backbone of the lecithin can be, for example, ethoxylated, acetylated, sulfonated, phosphorylated, or alkoxylated, or any combination thereof. Fatty acids can be exchanged by transesterification. In addition or in the alternative, any other modification known to those in the art is included within the scope of the invention. See, e.g., Szuhaj and List, eds., Lecithins, pp. 203-208, American Oil Chemists Society (1985), which is incorporated herein by reference in its entirety. The lecithin can be modified chemically, enzymatically, genetically, or any combination thereof. The lecithin can be deoiled, bleached, hydrolyzed, fractionated, extracted, transesterfied, or any combination thereof. The modified lecithin can be in any form, for example, solid (e.g., granular or powdered), liquid, plastic, emulsion, or the like, or any combination thereof. Solid lecithins, and modified forms thereof, can be made via deoiling by removing the neutral triglyceride oil from the lecithin. The oil can be extracted using acetone (Szuhaj and List, eds., Lecithins, American Oil Chemists Society (1985)). The modified lecithin can be complexed. The modified lecithin can have any desirable hydrophilic-lipophilic balance (HLB) value, for example, greater than about 2.0, greater than about 4.0, greater than about 6.0, greater than about 8.0, greater than about 10.0, greater than about 12.0, greater than about 14.0, greater than about 16.0, or greater than about 18.0. The anti-corrosion compositions of the invention, when provided as emulsions, can be provided as oil-in-water or water-in-oil emulsions.

Lecithin from any source can be used to produce modified lecithin. Lecithin is a phosphatide found in both plants and animals, as well as in other organisms. Lecithin can include phosphatidylcholine, phosphatidylethanolamine, phosphatidylserine, phosphatidylinositol, phosphatidic acid, or any combination thereof. The relative amounts of those species can vary and be varied. Naturally occurring lecithin is a mixture of the diglycerides of various fatty acids, such as stearic, palmitic, oleic, linoleic and linolenic acids linked to the choline ester of phosphoric acid. Examples of lecithins that can be used include those derived from plants such as soybean, rapeseed, peanut, safflower, cotton seed, sunflower or corn, and those derived from animal sources such as egg yolk. Synthesized lecithin, naturally-occurring lecithin, or a combination thereof can be used. Commercially available modified lecithins include, for example, Solec HR-2B, Solec A, Solec E, Solec K-EML from Solae LLC North America (St. Louis, Mo.) Emulfluid™ tailored lecithins from Cargill, Inc. (Minneapolis, Minn.); Yelkin™ 1018, Thermolec® 57, Thermolec® 200, and Thermolec® WFC from Archer Daniels Midland Company (Decatur, Ill.); Alcolec® Xtra-A, Alcolec® S, Alcolec® BS, Alcolec® Granules, Alcolec® F-100 Powder, Alcolec® FF-100 Fine Powder, Alcolec® Z-3, and Alcolec® 495 from American Lecithin Company (Oxford, Conn.), and modified lecithins from SanQun Industrial Co. Qingdao (Shandong, China). Any modified lecithin or combination thereof can be used, for example, those described in B. Szuhaj, Lecithins, Chapter 13, in Bailey's Industrial Oil and Fat Products, 6th edition, F. Shahidi, editor (2005), which is incorporated by reference herein in its entirety.

A combination of modified and unmodified lecithins can be used. For example, the weight ratio of modified to unmodified lecithin used can be from about 0.0001:1,000 to about 1,000:0.0001, from about 0.001:500 to about 500:0.001 from about 0.01:100 to about 100:0.01, from about 0.1:100 to about 100:0.1, from about 1:100 to about 100:1, from about 50:1 to about 1:50, from about 10:1 to about 1:10, from about 5:1 to about 1:5, from about 2:1 to about 1:2, or about 1:1, or any other suitable or effective ratio or intervening ratio range. The modified lecithin can be or include modified phosphatidylcholine, modified phosphatidylethanolamine, modified phosphatidylserine, modified phosphatidylinositol, or modified phosphatidic acid, or any combination thereof. The relative amounts of those species can vary and be varied.

The fatty acid portion(s) of the modified lecithin can include any type or combination of types of fatty acids. For example, the fatty acid can be propionic acid, butyric acid, valeric acid, caproic acid, enanthic acid, caprylic acid, pelargonic acid, capric acid, undecylic acid, lauric acid, tridecylic acid, myristic acid, pentadecylic acid, palmitic acid, margaric acid, stearic acid, nonadecylic acid, arachidic acid, heneicosylic acid, behenic acid, tricosylic acid, lignoceric acid, pentacosylic acid, cerotic acid, heptacosylic acid, montanic acid, nonacosylic acid, melissic acid, henatriacontylic acid, lacceroic acid, psyllic acid, geddic acid, ceroplastic acid, hexatriacontylic acid, myristoleic acid, palmitoleic acid, sapienic acid, oleic acid, elaidic acid, vaccenic acid, linoleic acid, linoleic acid, linolenic acid, arachidonic acid, eicosapentaenoic acid, erucic acid, docosahexaenoic acid, hexadecatrienoic acid (HTA), alpha-linolenic acid (ALA), stearidonic acid (SDA), eicosatrienoic acid (ETE), eicosatetraenoic acid (ETA), eicosapentaenoic acid (EPA), heneicosapentaenoic acid (HPA), docosapentaenoic acid (DPA), clupanodonic acid, docosahexaenoic acid (DHA), tetracosapentaenoic acid, tetracosahexaenoic acid (nisinic acid), linoleic acid (LA), gamma-linolenic acid (GLA), calendic acid, eicosadienoic acid, dihomo-gamma-linolenic acid (DGLA), arachidonic acid (AA), docosadienoic acid, adrenic acid, docosapentaenoic acid, tetracosatetraenoic acid, tetracosapentaenoic acid, palmitoleic acid, vaccenic acid, paullinic acid, oleic acid, elaidic acid, gondoic acid, mead acid, erucic acid, nervonic acid, aleuritic acid, catalpic acid, conjugated fatty acid, conjugated linoleic acid, cyclopropene acid, decanoic acid, 15,16-dihydroxy-alpha-eleostearic acid, dimer acid, docosatetraenoic acid, eicosatetraenoic acid, alpha-eleostearic acid, beta-eleostearic acid, erucic acid, 2-ethylhexanoic acid, gadoleic acid, heptadecanoic acid, heptanoic acid, heptanoic acid, hexanoic acid, hexatriacontanoic acid, 12-hydroxyeicosatetraenoic acid, 5-hydroxyeicosatetraenoic acid, jacaric acid, lesquerolic acid, malvalic acid, mead acid, trans-3-methyl-2-hexenoic acid, mycolic acid, neodecanoic acid, octadecatrienoic acid, alpha-parinaric acid, pentadecanoic acid, perfluorononanoic acid, perfluorooctanoic acid, phospholipid-derived fatty acids, pinolenic acid, punicic acid, ricinelaidic acid, ricinoleic acid, rumenic acid, stearic acid, stearidonic acid, tariric acid, tuberculostearic acid, undecylenic acid, or vernolic acid, or any combination thereof. The fatty acid can be linear, cyclic, saturated, unsaturated, conjugated, substituted, homogenous, heterogeneous, or any combination thereof.

The anti-corrosion composition can include or contain at least one fatty acid ester including a monoglyceride, a diglyceride, a triglyceride, or any combination thereof. This fatty acid ester can be distinct and independent from that of the at least one modified lecithin. The fatty acid ester can be an ester of sorbitan and a fatty acid, such as stearic acid. The fatty acid ester can be a polysorbate, such as one or more of a Polysorbate 20 to 80, such as Polysorbate 20, Polysorbate 30, Polysorbate 40, Polysorbate 50, Polysorbate 60, Polysorbate 70, or Polysorbate 80, or other polysorbates. The fatty acid portion of the fatty acid ester can be of any length, and can be, for example, any fatty acid described herein, or otherwise known, capable of being synthesized, or isolated from nature. The fatty acid can be linear, cyclic, saturated, unsaturated, conjugated, substituted, homogenous, heterogeneous, or any combination thereof.

The anti-corrosion composition can include or contain at least one EO/PO alkoxylate. The EO/PO alkoxylate can have an average molecular weight of from about 1,000 to about 10,000 Daltons. Any desirable ethylene oxide/propylene oxide (EO/PO) alkoxylate can be used. The EO/PO alkoxylate can include any suitable number of ethylene oxide and/or propylene oxide units. For example, the alkoxylate can have from about 2 to about 2,000, from about 10 to about 1,000, from about 25 to about 750, from about 50 to about 500, from about 75 to about 400, from about 100 to about 250, or greater than 2,000 alkylene oxide groups. The alcohol portion of the alkoxylate can be of any suitable length. The alcohol portion can be, for example, methanol, ethanol, propanol, butanol, and the like, or any combination thereof. The alcohol can be a primary alcohol, secondary alcohol, tertiary alcohol, or any combination thereof. The alcohol can be linear, cyclic, saturated, unsaturated, conjugated, substituted, homogenous, heterogeneous, or any combination thereof. The alkoxylate can be a copolymer, block copolymer, random copolymer, alternating copolymer, statistical copolymer, graft copolymer, or any combination thereof. The alkoxylate can include at least one homopolymer, at least one copolymer, or any combination thereof. EO/PO alkoxylates are available, for example, Tergitol XD from Dow Chemical Company, T-Det XD from Harcros Chemicals Kansas City, Kans. Midland, Mich., Perstorp Holding AB, Perstorp, Sweden, INEOS Group AG, Rolle, Switzerland, and Stepan Chemical Company Northfield, Ill.

The anti-corrosion composition can include or contain at least one polyethylene glycol ester. The polyethylene glycol ester can have an average molecular weight of from about 400 to about 10,000 Daltons. Any suitable polyethylene glycol (polyoxyethylene glycol; PEG) ester can be employed. The PEG portion can be of any desirable molecular weight, for example, at least 100 Daltons, at least 200 Daltons, at least 400 Daltons, at least 500 Daltons, at least 600 Daltons, at least 750 Daltons, at least 1,000 Daltons, at least 2,000 Daltons, at least 4,000 Daltons, at least 5,000 Daltons, at least 6,000 Daltons, at least 7,500 Daltons, at least 8,000 Daltons, at least 10,000 Daltons, at least 50,000 Daltons, or any intervening molecular weight, or any combination thereof. The PEG can be of any desirable geometry, for example, linear, branched, star, comb, or any combination thereof. The acid portion of the PEG ester can be of any length, and can be, for example, any fatty acid described herein. The acid can be linear, cyclic, saturated, unsaturated, conjugated, substituted, homogenous, heterogeneous, or any combination thereof, or otherwise known, capable of being synthesized, or isolated from nature. PEG esters are commercially available, for example from Jiangsu Haian Petrochemical Plant (Jiangsu, China) and Synasia Fine Chemicals Inc. (Metuchen, N.J.).

The anti-corrosion composition can include at least one glycol. The glycol can be propylene glycol, ethylene glycol, glycerin, and/or dipropylene glycol or any combinations thereof. The glycol can be one or more alkylene glycols.

The present invention further relates to an anti-corrosion composition comprising, consisting essentially of, consisting of, or including at least one fatty acid ester, at least one glycol, at least one sorbate, and at least one modified lecithin. The anti-corrosion composition can contain from about 5 wt % to about 45 wt % (e.g., from 5 wt % to 40 wt %, from 5 wt % to 35 wt %, from 5 wt % to 30 wt %, from 7 wt % to 30 wt %, from 10 wt % to 25 wt %) of the at least one fatty acid ester, from about 2 wt % to about 30 wt % (e.g., from 2 wt % to 25 wt %, from 2 wt % to 23 wt %, from 2 wt % to about 20 wt %, from 3 wt % to 20 wt %, from 3 wt % to 15 wt %, from 5 wt % to 15 wt %, from 5 wt % to 25 wt %, from 7 wt % to 20 wt %) of the at least one glycol, from about 0.005 wt % to about 5 wt % (e.g., from 0.01 wt % to 4.5 wt %, from 0.1 wt % to 4 wt %, from 0.2 wt % to 3.5 wt %, from 0.25 wt % to 3 wt %, from 0.3 wt % to 2.5 wt %, from 0.35 wt % to 2 wt %, from 0.4 wt % to 2 wt %, from 0.5 wt % to 1.5 wt %, from 0.6 wt % to 1 wt %) of the at least one sorbate, and from about 20 wt % to about 80 wt % (e.g., from 20 wt % to 75 wt %, from 20 wt % to 70 wt %, from 20 wt % to 60 wt %, from 20 wt % to 50 wt %, from 20 wt % to 45 wt %, from 25 wt % to 80 wt %, from 30 wt % to 80 wt %, from 35 wt % to 80 wt %, from 40 wt % to 85 wt %, from 50 wt % to 80 wt %) of the at least one modified lecithin, based on the total weight of the anti-corrosion composition. The balance, if any, can be inert ingredients, aqueous or non-aqueous solvents, or other ingredients described in this disclosure, and the like. More than one component can comprise each amount. As an example, the 5 wt % to 45 wt % of at least one fatty acid ester can comprise at least one polyethoxylated sorbitan fatty acid ester (e.g., polysorbate) and at least one different fatty acid ester (e.g., a monoglyceride, diglyceride, and/or triglyceride, individually or in any mixture thereof) in any weight ratios, such as a weight ratio of from about 1/1 to about 10/1 of the polysorbate to total other fatty acid esters, respectively, on a weight:weight basis (e.g., from 3/1 to 9/1, from 4/1 to 8/1, or from 5/1 to 7/1, or about 6/1 wt:wt, respectively). As another example, the 20 wt % to 80 wt % of modified lecithin can comprise two or three different modified lecithins in any weight ratios, and so on.

For this additional anti-corrosion composition that contains at least one fatty acid ester, at least one glycol, at least one sorbate, and at least one modified lecithin, examples and details of the at least one fatty acid ester, the at least one glycol, and the at least one modified lecithin components can be the same as the components used in the earlier anti-corrosion composition, to the extent that they overlap. As indicated, the at least one fatty acid ester component in this composition can be a combination of two or more different fatty acid esters, such as a combination of at least one polyethoxylated sorbitan fatty acid ester (e.g., a polysorbate) and at least one of a monoglyceride, diglyceride, or triglyceride, or any mixture thereof. The sorbate can be in the form of free sorbic acid (2,4-hexadienoic acid), a salt thereof, or any combination thereof. The sorbate salt can be potassium sorbate, sodium sorbate, calcium sorbate, or other sorbate salt, or any combination thereof. The sorbate preferably is a sorbate preservative. A sorbate preservative can be an antimicrobial agent, such as an agent useful to inhibit the growth of mold, yeast, and/or fungi.

The present invention provides a method of preparing an anti-corrosion composition. The method can include blending at least one modified lecithin alone, at a temperature of from about 40° C. to about 80° C. for a period of from about 10 minutes to about 60 minutes (or more) or with one or more other ingredients of the anti-corrosion composition. Referencing one of the indicated compositions for sake of illustration, the at least one modified lecithin can be blended with at least one fatty acid ester, at least one glycol, at least one EO/PO alkoxylate, and/or at least one polyethylene glycol ester, and/or any combination thereof. The modified lecithin can be blended with at least one fatty acid ester, at least one glycol, at least one EO/PO alkoxylate, and at least one polyethylene glycol ester. The blending can be performed at a speed of from about 10 rpm to about 1,000 rpm. The various ingredients that form the anti-corrosion compositions of the present invention can be mixed together using conventional mixing techniques, such as agitation, stirring, or blending, or any combination thereof. Devices such as a mixer, a blender, a paddle, a stirrer, a closed vessel and/or an open vessel can be used for mixing. A similar method can be used to prepare an anti-corrosion composition that contains the at least one modified lecithin as blended with the at least one fatty acid ester, the at least one glycol, and the at least one sorbate.

Depending on its use, a composition according to the present invention can be prepared in various forms. For example, the composition can be prepared in liquid form as a solution, dispersion, emulsion, suspension, or paste; a dispersion, suspension, or paste in a non-solvent; or as a solution by dissolving the at least one modified lecithin, as well as other components of the anti-corrosion composition, in a solvent or combination of solvents. Suitable solvents include, but are not limited to, acetone, glycols, alcohols, ethers, water, or other water-dispersible solvents. The composition can be prepared as a liquid concentrate for dilution prior to its intended use. Common additives such as surfactants, emulsifiers, dispersants, and the like can be used as known in the art to increase the solubility of the at least one modified lecithin, as well as other components of the anti-corrosion composition, in a liquid composition or system, such as an aqueous or non-aqueous composition or system.

The composition of the present invention can be considered a mixture or formulation. The composition can be highly dispersible to soluble in water. For instance, the solubility of the composition at 20° C. can be from about 1 wt % to about 25 wt % of the composition (based on the total weight of the composition) in water, or from about 1 g/100 g water to about 27 g/100 g water or higher, or from about 2 g/100 g water to about 25 g/100 g water or from about 5 g/100 g water to about 22 g/100 g water, or from about 10 g/100 g water to about 20 g/100 g water, or at least 5 g/100 g water, or at least 10 g/100 water, or at least 15 g/100 g water, or at least 20 g/100 g water, with the "g" referring to the grams of the composition of the present invention.

A composition of the present invention can be prepared in solid form. For example, the at least one modified lecithin, as well as other components of the anti-corrosion composition, can be formulated as a powder or tablet using means known in the art. The tablets can contain a variety of excipients known in the tableting art. Other components known in the art such as fillers, binders, glidants, lubricants, or antiadherents can be included. These components can be included to improve tablet properties and/or the tableting process.

An anti-corrosion composition including at least one modified lecithin can be formulated by sequentially or simultaneously combining the components in a fluid medium, such as water. The order of addition of the components is not limited. The pH of the resulting combination generally can be controlled, for example, to a defined level of a pH of from about 2 to about 14, or a pH of from about 4 to about 12, or a pH of from about 7 to about 11, or from about 9 to about 10. These pH ranges can apply to the anti-corrosion composition to in an aqueous or non-aqueous solution. Adjustment of the pH of the composition can be accomplished, for example, through the addition of either sodium hydroxide or ammonium hydroxide (aqueous ammonia).

The anti-corrosion composition can be prepared as masterbatches for dilution at a later time or the desirable concentration can be made at the same time that the composition is prepared. The anti-corrosion composition can be prepared on-site or off-site or parts or components of the composition can be prepared or pre-mixed off-site or on-site prior to the ultimate formation of the composition. The anti-corrosion compositions can be formed immediately prior to application to a metal surface or system including at least one metal surface, or the compositions can be prepared beforehand, such as before use, minutes before use, hours before use, or days or weeks or months before use, for example, within about 2 to 3 weeks of usage. When the anti-corrosion composition is introduced as a pre-mixture, the pre-mixture can be made from about 1.0 to about 100 seconds before application, or from about 1.0 hour to about 5 hours, from about 1.0 hour to about 10 hours, from about 1.0 hour to about 24 hours before use, from about 1.0 day to about 7.0 days, from about 1.0 day to about 30 days, from about 1.0 day to about 60 days, or from about 1 day to about 180 days, before use.

The present invention provides a method of inhibiting corrosion of a metal surface including applying an anti-corrosion composition containing at least one modified lecithin to the metal surface in an amount effective to inhibit corrosion of the metal surface, wherein the at least one modified lecithin is or includes acetylated lecithin, ethoxylated lecithin, hydroxylated lecithin, sulfonated lecithin, phosphorylated lecithin, halogenated, lecithin, hydroxylated lecithin, alkoxylated lecithin, chemically modified lecithin, or enzymatically modified lecithin, or any combination thereof. The method can employ an anti-corrosion composition further containing at least one fatty acid ester, at least one glycol, at least one EO/PO alkoxylate, and/or at least one polyethylene glycol ester, or any combination thereof. The method can employ an anti-corrosion composition further containing at least one fatty acid ester, at least one glycol, and at least one sorbate.

The anti-corrosion composition can be applied by itself to a metal surface or applied as part of a fluid that can optionally contain one or more additional components, for example, an additional anti-corrosion agent and/or a biocide. When combined with one or more additional anti-corrosion agent, the resulting corrosion inhibition can be sub-additive, additive, or super-additive (synergistic). The fluid can include a liquid, a vapor (gas), or a combination thereof. The fluid can include at least one of $H_2O$, $NH_3$, and an alcohol. The fluid can be aqueous, non-aqueous, or both. The fluid can include an acid or base in addition to the at least one modified lecithin, as well as other components of the anti-corrosion composition. The fluid can include a salt solution of at least one salt.

The at least one modified lecithin, as well as other components of the anti-corrosion composition, can be applied directly or indirectly to a metal surface using any appropriate technique. For example one or more of flowing, coating, sponging, wiping, spraying, painting, showering, and misting of the at least one modified lecithin, as well as other components of the anti-corrosion composition, to the metal surface can be employed. The applying can include flowing a fluid containing at least one modified lecithin, as well as other components of the anti-corrosion composition, over the metal surface. The method can include forming a protective film on the metal surface including at least one modified lecithin, as well as other components of the anti-corrosion composition.

The fluid can be cooled or heated, or be provided at ambient temperature. For example, the fluid, or a component thereof, can be greater than about −200° C., greater than about −150° C., greater than about −100° C., greater than about −50° C., greater than about −25° C., less than 0.0° C., greater than about 0.0° C., greater than about 5.0° C., greater than about 10° C., greater than about 25° C., greater than about 40° C., greater than about 50° C., greater than about 60° C., greater than about 75° C., greater than about 90° C., greater than about 99° C., about 100° C., greater than about 100° C., greater than about 150° C., greater than about 200° C., or greater than about 250° C. The pH of the fluid can be neutral or from about 1.0 to about 14, from about 2.0 to about 12, from about 4.0 to about 10, or from about 6.0 to about 8.0.

The concentration of the at least one modified lecithin, as well as other components of the anti-corrosion composition, can be adjusted according to the particular metal surface(s) being treated and the parameters of the system in which it is employed. The concentration of at least one modified lecithin, as well as other components of the anti-corrosion composition, in a fluid system can be less than 0.001 ppm, greater than 0.001 ppm, from about 0.001 ppm to about 10,000 ppm from about 0.01 to about 1,000 ppm, from about 0.1 ppm to about 100 ppm, or from about 1.0 ppm to about 50 ppm, or from about 0.5 ppm to about 40 ppm, or from about 1 ppm to about 30 ppm, or from about 1 ppm to about 20 ppm, or from about 1 ppm to about 15 ppm, or from about 1 ppm to about 10 ppm, or from about 0.5 ppm to about 5 ppm. The at least one modified lecithin, as well as other components of the anti-corrosion composition, can be prepared as a stock solution of from about 0.01 wt % to about 100 wt %, from about 0.1 wt % to about 95 wt %, from about 1.0 wt % to about 80 wt %, from about 5.0 wt % to about 75 wt %, from about 10 wt % to about 60 wt %, from about 15 wt % to about 50 wt % from about 25 wt % to about 40 wt % of the at least one modified lecithin, as well as other components of the anti-corrosion composition, thereof based on the total weight of the stock solution. The at least one modified lecithin, as well as other components of the anti-corrosion composition, can be used in the methods of the invention as a solid, liquid, and/or gaseous formulation. The methods according to the invention can be part of an overall water treatment regimen. The at least one modified lecithin, as well as other components of the anti-corrosion composition, can be used with other water treatment chemicals, such as biocides (e.g., algicides, fungicides, bactericides, molluscicides, oxidizers, etc.), stain removers, clarifiers, flocculants, coagulants, or other chemicals commonly used in water treatment.

Each component of the anti-corrosion composition, can be applied to the metal surface or to a fluid to be applied to the metal surface at the same time, for example, in the form of a pre-made or pre-formed stabilizer composition, or the components can be added (in any order) sequentially within a period of time (e.g., within 1.0 second to 10 minutes) to permit the components to interact in combination with the metal surface. The individual components of the anti-corrosion composition can be pre-combined as a pre-mixture, and then added together in anti-corrosion composition to the metal surface. The individual components can be co-mixed in an addition pipeline or other feedline that feeds the resulting co-mixture to an introduction port. The individual components can be added separately and simultaneously to the aqueous solution from different introduction ports on the same processing unit. The individual components can be introduced sequentially, that is, separately at separate times, from the same or different introduction ports or locations in a system including one or more metal surface. In sequential addition, the individual components, including at least one modified lecithin can be separately added in time with all components brought into contact with the metal surface within a short period of time, for example, within about 5 minutes of each other, or within about 4 minutes of each other, or within about 2 minutes of each other, or within about 1 minute of each other, or within about 30 seconds of each other, or within shorter periods of time.

The corrosion of any metal surface can be inhibited using the methods of the invention. Any metal, combination of metals, or alloys can be protected. Examples of metal surfaces include industrial metals or metal alloys or metal coated articles. Examples of metal surfaces include those containing one or more of scandium, titanium, vanadium, chromium, manganese, iron, cobalt, nickel, copper, zinc, yttrium, zirconium, platinum, gold, mercury, niobium, iridium, molybdenum, technetium, ruthenium, rhodium, palladium, silver, cadmium, hafnium, tantalum, tungsten, rhenium, osmium, aluminum, indium, germanium, gallium, antimony, tin, lead, bismuth, cerium, praseodymium, neodymium, promethium, samarium, europium, gadolinium, terbium, dysprosium, holmium, erbium, thulium, and ytterbium. The metal alloy can be bronze, chrome, stainless steel, steel and the like. The metal surface can be a ferrous or a non-ferrous surface. The metal surface can be continuous or discontinuous. The metal surface can have any shape, dimension, or surface texture. The metal can be embedded in one or more non-metal media such as a plastic, a rubber, a glass, a ceramic, a composite, or the like. The metal can be electroplated. The metal can be galvanized. A constant or variable electric current and/or magnetic field can be applied to the metal surface. The metal surface can be heated or cooled.

The method of the invention can further include contacting the metal surface with at least one corrosive agent from which protection is sought. The applying of the at least one modified lecithin, as well as the other optional components of the anti-corrosion composition, can be performed before, during, and/or after the contacting of the metal surface with the at least one corrosive agent. The metal surface can be part of a closed fluid system or an open fluid system, or both. Examples of systems that can be treated include, but are not limited to, cooling systems, heating systems, cooling towers, boilers, radiators, steam piping, oil transport machinery and piping, oil production machinery and piping, paper and pulp machinery, plumbing, automobiles, trains, aircraft, spacecraft, airports, ports, boats, bridges, tunnels, roadways, railroads, buildings, factories, electronics, cables, and hardware.

The anti-corrosion compositions described herein can also be used as an corn oil additive, a boiler water treatment aid, a cooling tower additive, a paper machine defoamer, a nickel defoamer, a metal flotation aid, a heat transfer system additive, a beverage system additive, a mechanical coolant system additive, a radiator additive, a creping release additive, a repulping additive, a coating defoamer, a metal working fluid, and an enzyme fixation agent.

The present invention provides a method of inhibiting corrosion of a metal surface including applying an anti-corrosion composition containing at least one modified lecithin to the metal surface in an amount effective to inhibit corrosion of the metal surface. Any type of corrosion can be inhibited as characterized by cause and/or effect. For example, the corrosion can include uniform corrosion that extends evenly across the surface, pitting corrosion that is uneven and has smaller deep areas (pits), exfoliation corrosion that moves along layers of elongated grains, and/or intergranular corrosion that grows along grain boundaries.

An amount effective to inhibit corrosion is an amount that results in a lower degree of chemical change of the metal surface in the presence of an anti-corrosion inhibitor than in its absence. Corrosion inhibition can be partial inhibition or complete inhibition. The chemical change can be measured, for example, by measuring a change in weight of the metal surface and/or by measuring the concentration of metal, ions thereof, or salts thereof originating from the metal surface in fluid that flow past the metal surface. The weight loss, for example, of a corrosion coupon after exposure to a corrosive environment can be expressed as mils (thousandths of an inch) per year penetration (MPY). The corrosion rate can be calculated with the assumption of uniform corrosion over the entire surface of the coupon. MPY can be calculated by multiplying the weight loss in grams by 22,300 and then dividing by the product of the area of coupon (sq. in.), the metal density of the coupon (g/cm$^3$), and the time of exposure in a corrosive environment (days). 1 MPY is equal to 0.0254 mm/y, which is equal to 25.4 μm/y. Accordingly, corrosion rate from metal loss can be calculated as mm/y=87.6×(W/DAT) with W (weight loss in milligrams), D (metal density in g/cm$^3$), A (area of sample in cm$^2$), and T (time of exposure of the metal sample in hours).

Metal corrosion can occur via electrochemical reactions at the interface between a metal and an electrolyte solution. A thin film of moisture on a metal surface forms the electrolyte for atmospheric corrosion. Corrosion normally occurs at a rate determined by an equilibrium between opposing electrochemical reactions, anodic (metal oxidation) and cathodic (reduction of a solution species). When these two reactions are in equilibrium, the flow of electrons from each reaction is in balance, and no net flow of electricity occurs. The two reactions can occur on one metal or on two or more dissimilar metals that are in electrical communication. Corrosion current can used to generate corrosion rate by assuming an electrolytic dissolution reaction involving a chemical species, S, by the reaction $S \Rightarrow S^{n+} + ne^-$. Current flow can be related to mass via Faraday's Law: Q=nFM, where Q is the charge in coulombs resulting from the reaction of species S, n is the number of electrons transferred per molecule or atom of S, F is Faraday's constant (96,486.7 coulombs/mole), and M is the number of moles of species S reacting. This relationship can also be employed using equivalent weight (EW), the mass of species S that will react with one Faraday of charge. For an atomic species, EW=AW/n, where AW is the atomic weight of the species. Substitution of M=W/AW into the Q=nFM equation yields, W (mass of species S that has reacted)=(EW×Q)/F. Uniform corrosion across a metal surface allows calculation of the corrosion rate in units of distance per year. For an alloy undergoing uniform dissolution, the equivalent weight is a weighted average of the equivalent weights of the alloy components. Mole fraction, as opposed to mass fraction, can be used as the weighting factor. If the dissolution is not uniform, corrosion products can be used to calculate EW.

A weight loss can be converted to a corrosion rate (CR) with knowledge of the density (d) and the sample area (A). Charge is expressed by Q=I×T, where T is the time in seconds and I is the current. The corrosion rate is equal to $(I_c \times K \times EW)/dA$, wherein $I_c$ is the corrosion current in amps, K is a constant (3272 mm/(amp·cm·year) for MMPY or $1.288 \times 10^5$ milli-inches/(amp·cm·year) for MPY), EW is the equivalent weight in grams, d is the density in grams/cm$^3$, and A is the sample area in cm$^2$. ASTM Standard G 102, Standard Practice for Calculation of Corrosion Rates and Related Information from Electrochemical Measurements can be used. An eddy current instrument and probe can be used for measuring corrosion by monitoring a conductivity curve and impedance plane and using one or more techniques such as single layer corrosion detection, two layer corrosion detection, a limited penetration method, dual frequency method, and/or a variable frequency method.

The following examples are intended to illustrate, not limit, the present invention.

EXAMPLES

Example 1

This example includes comparison testing of modified lecithin against unmodified lecithin. A test volume of 400 ml was employed. The solution used was based on deionized water. The temperature of the solution was 70° C. at a pH of 8. The formulas were dosed at 75 ppm. A mild steel coupon was immersed in the solution. The blank/control has no inhibitor dosed into the solution. The test set was run for a little over 7 days. Bulab™ 3886, available from Buckman Laboratories, Inc., Memphis, Tenn., was used as a positive control as a non-amine film-former. The formulation used in each test was as follows (with wt % based on the weight of the formulation):

PEG 400—25 wt %

SPAN 60 (sorbitan monostearate)—10 wt %

Tergitol XD—5 wt %

Propylene glycol—6 wt %

Lecithin (unmodified or modified) or Bulab 3886—54 wt %

For the blank/control, 100 wt % of DI water was used. Formulations containing acetylated lecithin, enzyme-modified lecithin, and unmodified lecithin, respectively, were employed for the "lecithin" in the above formulation. A lower MPY score indicates less corrosion and, accordingly, better corrosion protection. The results were as follows (MPY): blank/control (4.95), Bulab™ 3886 (0.23), acetylated lecithin (0.16), enzyme-modified lecithin (0.16), and unmodified lecithin (3.49). These tests were repeated for some of the formulations at a pH of about 6 and a pH of about 7, and while corrosion increased for all formulations tested at the lower pHs, the formulations of the present invention were still more effective in inhibiting corrosion compared to the blank/control, such as on the order of at least 15% to 20% less MPY. These results demonstrate that modified lecithin formulations can provide superior anti-corrosion results compared to existing anti-corrosion composition and compared to unmodified lecithin. It was especially unexpected and surprising that the modified lecithins of the present invention were significantly more effective in inhibiting corrosion compared to unmodified lecithin.

Example 2

This example includes comparison testing of an anti-corrosion composition which included modified lecithin, fatty acid esters, glycol, and sorbate against a commercial product and a blank/control. The testing protocols, conditions, and mild steel coupons that were used in these tests were similar to those described in Example 1. These tests were run at a solution pH of 6. As in Example 1, a blank/control had no inhibitor dosed into the solution (Blank). Bulab™ 3886 again was used as a positive control (Product A). A formulation was used having the composition indicated in Table 1 below (Product B). All of the components in Product B are approved for FDA contact. A Product C formulation also was prepared and tested which was a similar formulation to Product B.

TABLE 1

| Component (Product B) | Percentage wt % |
|---|---|
| Polysorbate 60[a] | 30.0 |
| Propylene glycol | 20.0 |
| Modified lecithin[b] | 44.6 |
| Mono- and di-glyceride mixture[c] | 5.0 |
| Potassium sorbate | 0.4 |

[a]TWEEN 60 (polyoxyethylene (20) sorbitan monostearate).

[b]Lecithin Solec HR2B from Solae.

[c]Lumulse GMO-K from Lambent Technologies (glyceryl oleate as a mixture of monoleate and di-oleate esters).

TABLE 2

| Component (Product C) | Percentage wt % |
|---|---|
| Polysorbate 60[a] | 27.0 |
| Propylene glycol | 23.0 |
| Modified lecithin[b] | 40.4 |

TABLE 2-continued

| Component (Product C) | Percentage wt % |
|---|---|
| PE 108K Phosphated mono- and diglycerides, sodium salt | 9.0 |
| Potassium sorbate | 0.4 |

The results of the tests are shown in the FIGURE. The bar graphs of the results show that the corrosion weight loss was unexpectedly and surprisingly less for Product B and Product C (both of the present invention) than for the commercial product and the blank/control. These results demonstrate that an anti-corrosion composition of the present invention can provide superior anti-corrosion results.

The present invention includes the following aspects/embodiments/features in any order and/or in any combination:

1. An anti-corrosion composition comprising at least one fatty acid ester, at least one glycol, at least one ethylene oxide/propylene oxide (EO/PO) alkoxylate, at least one polyethylene glycol ester, and at least one modified lecithin.

2. The anti-corrosion composition of any preceding or following embodiment/feature/aspect, comprising from about 5 wt % to about 20 wt % of the at least one fatty acid ester, from about 2 wt % to about 20 wt % of the at least one glycol, from about 1 wt % to about 10 wt % of the at least one EO/PO alkoxylate, from about 10 wt % to about 50 wt % of the at least one polyethylene glycol ester, and from about 20 wt % to about 80 wt % of the at least one modified lecithin, based on the total weight of the anti-corrosion composition.

3. The anti-corrosion composition of any preceding or following embodiment/feature/aspect, wherein the at least one modified lecithin comprises acetylated lecithin, ethoxylated lecithin, hydroxylated lecithin, sulfonated lecithin, phosphorylated lecithin, halogenated, lecithin, hydroxylated lecithin, alkoxylated lecithin, chemically modified lecithin, or enzymatically modified lecithin, or any combination thereof.

4. The anti-corrosion composition of any preceding or following embodiment/feature/aspect, wherein the at least one modified lecithin comprises modified phosphatidylcholine, modified phosphatidylethanolamine, modified phosphatidylserine, modified phosphatidylinositol, or modified phosphatidic acid, or any combination thereof.

5. The anti-corrosion composition of any preceding or following embodiment/feature/aspect, wherein the at least one fatty acid ester comprises a monoglyceride, a diglyceride, or a triglyceride, or any combination thereof.

6. The anti-corrosion composition of any preceding or following embodiment/feature/aspect, wherein the at least one EO/PO alkoxylate has an average molecular weight of from about 1,000 to about 10,000 Daltons.

7. The anti-corrosion composition of any preceding or following embodiment/feature/aspect, wherein the at least one polyethylene glycol ester has an average molecular weight of from about 400 to about 10,000 Daltons.

8. An anti-corrosion composition comprising at least one fatty acid ester, at least one glycol, at least one sorbate, and at least one modified lecithin.

9. The anti-corrosion composition of any preceding or following embodiment/feature/aspect, comprising from about 5 wt % to about 45 wt % of the at least one fatty acid ester, from about 2 wt % to about 30 wt % of the at least one glycol, from about 0.005 wt % to about 5 wt % of the at least one sorbate, and from about 20 wt % to about 80 wt % of the at least one modified lecithin, based on the total weight of the anti-corrosion composition.

10. The anti-corrosion composition of any preceding or following embodiment/feature/aspect, wherein the at least one modified lecithin comprises acetylated lecithin, ethoxylated lecithin, hydroxylated lecithin, sulfonated lecithin, phosphorylated lecithin, halogenated, lecithin, hydroxylated lecithin, alkoxylated lecithin, chemically modified lecithin, or enzymatically modified lecithin, or any combination thereof.

11. The anti-corrosion composition of any preceding or following embodiment/feature/aspect, wherein the at least one modified lecithin comprises modified phosphatidylcholine, modified phosphatidylethanolamine, modified phosphatidylserine, modified phosphatidylinositol, or modified phosphatidic acid, or any combination thereof.

12. The anti-corrosion composition of any preceding or following embodiment/feature/aspect, wherein the at least one fatty acid ester comprises polysorbate and at least one of a monoglyceride, a diglyceride, a triglyceride, or any combination thereof.

13. A method of preparing an anti-corrosion composition, comprising blending at least one modified lecithin at a temperature of from about 40° C. to about 80° C. for a period of from about 10 minutes to about 60 minutes.

14. The method of any preceding or following embodiment/feature/aspect, wherein the at least one modified lecithin is blended with at least one fatty acid ester, at least one glycol, at least one EO/PO alkoxylate, or at least one polyethylene glycol ester, or any combination thereof.

15. The method of any preceding or following embodiment/feature/aspect, wherein the at least one modified lecithin is blended with at least one fatty acid ester, at least one glycol, at least one EO/PO alkoxylate, and at least one polyethylene glycol ester.

16. The method of any preceding or following embodiment/feature/aspect, wherein the at least one modified lecithin is blended with at least one fatty acid ester, at least one glycol, and at least one sorbate.

17. The method of any preceding or following embodiment/feature/aspect, wherein the blending is performed at a speed of from about 10 rpm to about 1,000 rpm.

18. A method of inhibiting corrosion of a metal surface comprising applying an anti-corrosion composition comprising at least one modified lecithin, to the metal surface in an amount effective to inhibit corrosion of the metal surface, wherein the at least one modified lecithin comprises acetylated lecithin, ethoxylated lecithin, hydroxylated lecithin, sulfonated lecithin, phosphorylated lecithin, halogenated, lecithin, hydroxylated lecithin, alkoxylated lecithin, chemically modified lecithin, or enzymatically modified lecithin, or any combination thereof.

19. The method of any preceding or following embodiment/feature/aspect, wherein the anti-corrosion composition further comprises at least one fatty acid ester, glycol, at least one EO/PO alkoxylate, or at least one polyethylene glycol ester, or any combination thereof.

20. The method of any preceding or following embodiment/feature/aspect, wherein the anti-corrosion composition comprises at least one modified lecithin, at least one fatty acid ester, at least one glycol, at least one EO/PO alkoxylate, and at least one polyethylene glycol ester.

21. The method of any preceding or following embodiment/feature/aspect, wherein the anti-corrosion composition comprises at least one modified lecithin, at least one fatty acid ester, at least one glycol, and at least one sorbate.

22. The method of any preceding or following embodiment/feature/aspect, further comprising forming a film of the anti-corrosion composition on the metal surface.

23. The method of any preceding or following embodiment/feature/aspect, further comprising adding the composition to a fluid, wherein the applying comprises applying the fluid to the metal surface.

24. The method of any preceding or following embodiment/feature/aspect, wherein the fluid comprises at least one of a liquid and a vapor.

25. The method of any preceding or following embodiment/feature/aspect, wherein the fluid comprises at least one of $H_2O$, $NH_3$, and an alcohol.

26. The method of any preceding or following embodiment/feature/aspect, wherein the fluid comprises an acid or base.

27. The method of any preceding or following embodiment/feature/aspect, wherein the fluid comprises a salt solution.

28. The method of any preceding or following embodiment/feature/aspect, wherein the applying comprises flowing, coating, sponging, wiping, spraying, painting, showering, or misting of the anti-corrosion composition, or a combination thereof.

29. The method of any preceding or following embodiment/feature/aspect, further comprising contacting the metal surface with at least one corrosive agent.

30. The method of any preceding or following embodiment/feature/aspect, wherein the applying is performed before, during, and/or after the contacting.

31. The method of any preceding or following embodiment/feature/aspect, wherein the metal surface is part of a closed fluid system.

32. A composition comprising at least one fatty acid ester, at least one glycol, at least one ethylene oxide/propylene oxide (EO/PO) alkoxylate, at least one polyethylene glycol ester, and at least one modified lecithin, wherein said composition is utilized as a corn oil additive, a boiler water treatment aid, a cooling tower additive, a paper machine defoamer, a nickel defoamer, a metal flotation aid, a heat transfer system additive, a beverage system additive, a mechanical coolant system additive, a radiator additive, a creping release additive, a repulping additive, a coating defoamer, a metal working fluid, or an enzyme fixation agent.

The present invention can include any combination of these various aspects, features, or embodiments above and/or below as set forth in sentences and/or paragraphs. Any combination of disclosed features herein is considered part of the present invention and no limitation is intended with respect to combinable features.

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

It will be apparent to those skilled in the art that various modifications and variations can be made to the embodiments of the present invention without departing from the spirit or scope of the present invention. Thus, it is intended that the present invention covers other modifications and variations of this invention provided they come within the scope of the appended claims and their equivalents.

What is claimed is:

1. An anti-corrosion composition comprising from about 5 wt % to about 20 wt % of at least one fatty acid ester, from about 2 wt % to about 20 wt % of at least one glycol, from about 1 wt % to about 10 wt % of at least one ethylene oxide/propylene oxide (EO/PO) alkoxylate, from about 35 wt % to about 54 wt % of at least one modified lecithin, based on a total weight of the anti-corrosion composition, and a balance of the composition comprising polyethylene glycol, wherein the at least one modified lecithin comprises acetylated lecithin, and wherein the at least one glycol comprises an alkylene glycol, glycerin, or any combination thereof.

2. The anti-corrosion composition of claim 1, wherein the at least one modified lecithin comprises modified phosphatidylcholine, modified phosphatidylethanolamine, modified phosphatidylserine, modified phosphatidylinositol, or modified phosphatidic acid, or any combination thereof.

3. The anti-corrosion composition of claim 1, wherein the at least one fatty acid ester comprises a monoglyceride, a diglyceride, or a triglyceride, or any combination thereof.

4. The anti-corrosion composition of claim 1, wherein the at least one EO/PO alkoxylate has an average molecular weight of from about 1,000 to about 10,000 Daltons.

5. The anti-corrosion composition of claim 1, wherein the at least one the polyethylene glycol has an average molecular weight of from about 400 to about 10,000 Daltons.

6. An anti-corrosion composition comprising from about 5 wt % to about 45 wt % of at least one fatty acid ester, from about 2 wt % to about 30 wt % of at least one glycol, from about 0.005 wt % to about 5 wt % of at least one sorbate, and from about 40 wt % to about 45 wt % of at least one modified lecithin, based on a total weight of the anti-corrosion composition, wherein the at least one modified lecithin comprises acetylated lecithin.

7. The anti-corrosion composition of claim 6, wherein the at least one modified lecithin comprises modified phosphatidylcholine, modified phosphatidylethanolamine, modified phosphatidylserine, modified phosphatidylinositol, or modified phosphatidic acid, or any combination thereof.

8. The anti-corrosion composition of claim 6, wherein the at least one fatty acid ester comprises polysorbate and at least one of a monoglyceride, a diglyceride, a triglyceride, or any combination thereof.

9. The anti-corrosion composition of claim 6, comprising:

from about 35 wt % to about 45 wt % of at least one fatty acid ester, from about 15 wt % to about 30 wt % of at least one glycol, from about 0.2 wt % to about 2 wt % of at least one sorbate, and from about 35 wt % to about 54 wt % of at least one modified lecithin, based on a total weight of the anti-corrosion composition, wherein the at least one modified lecithin comprises acetylated lecithin.

10. A method of inhibiting corrosion of a metal surface comprising applying an anti-corrosion composition to the metal surface in an amount effective to inhibit corrosion of the metal surface, wherein the composition comprises from about 5 wt % to about 20 wt % of at least one fatty acid ester, from about 2 wt % to about 20 wt % of at least one glycol, from about 1 wt % to about 10 wt % of at least one ethylene oxide/propylene oxide (EO/PO) alkoxylate, from about 35 wt % to about 54 wt % of at least one modified lecithin, based on a total weight of the anti-corrosion composition, and a balance of the composition comprising polyethylene glycol, and wherein the at least one modified lecithin comprises acetylated lecithin and wherein the at least one glycol comprises an alkylene glycol, glycerin, or any combination thereof.

11. The method of claim 10, wherein the anti-corrosion composition further comprises at least one polyethylene glycol ester.

12. The method of claim 10, wherein the anti-corrosion composition further comprises at least one sorbate.

13. The method of claim 10, further comprising forming a film of the anti-corrosion composition on the metal surface.

14. The method of claim 10, further comprising adding the composition to a fluid, wherein the applying comprises applying the fluid to the metal surface.

15. The method of claim 14, wherein the fluid comprises at least one of a liquid and a vapor.

16. The method of claim 14, wherein the fluid comprises at least one of $H_2O$, $NH_3$, and an alcohol.

17. The method of claim 14, wherein the fluid comprises an acid or base.

18. The method of claim 14, wherein the fluid comprises a salt solution.

19. The method of claim 10, wherein the applying comprises flowing, coating, sponging, wiping, spraying, painting, showering, or misting of the anti-corrosion composition, or a combination thereof.

20. The method of claim 10, further comprising contacting the metal surface with at least one corrosive agent.

21. The method of claim 20, wherein the applying is performed before, during, and/or after the contacting.

22. The method of claim 10, wherein the metal surface is part of a closed fluid system.

* * * * *